United States Patent [19]

Killen

[11] Patent Number: 4,513,961

[45] Date of Patent: Apr. 30, 1985

[54] TOGGLE BAR FOR EXERCISE AND HEALTH PURPOSES

[75] Inventor: Robert H. Killen, Pasadena, Calif.

[73] Assignee: Gravity Guidance, Inc., Duarte, Calif.

[21] Appl. No.: 394,404

[22] Filed: Jul. 1, 1982

[51] Int. Cl.[3] ..... A63B 1/02

[52] U.S. Cl. ..... 272/62; 272/93; 272/112

[58] Field of Search ..... 272/62, 54, 125, 126, 272/63, 93, 143, 116, 68, 112; 135/DIG. 9; 248/214, 215, 340, 341, 305; D21/191, 197, 198, 222; 24/339

[56] References Cited

U.S. PATENT DOCUMENTS

| | | | |
|---|---|---|---|
| 2,485,838 | 10/1949 | Nicol | 248/214 |
| 3,837,642 | 9/1974 | Martin | 272/62 |
| 4,211,402 | 7/1980 | Carroll | 272/143 |
| 4,257,591 | 3/1981 | Evans | 272/125 |
| 4,272,072 | 6/1981 | Kusmer | 272/143 |

FOREIGN PATENT DOCUMENTS

| | | | |
|---|---|---|---|
| 905443 | 7/1972 | Canada | 272/112 |
| 529514 | 7/1931 | Fed. Rep. of Germany | 24/339 |
| 1099326 | 9/1955 | France | 24/339 |

*Primary Examiner*—Richard J. Apley
*Assistant Examiner*—S. R. Crow
*Attorney, Agent, or Firm*—Zarley, McKee, Thomte, Voorhees & Sease

[57] ABSTRACT

An improvement in a toggle bar for brachiation in place by the upper limbs for purposes of exercise and health, including an elongated tubular middle-section bar having a handle defining an enclosed opening mounted upon both ends. A J-shaped hook is mounted at the mid-section of the bar for reception of a suspended support whereby the bar is pivotally movable with respect thereto. In modification, a toggle bar wherein the entire bar is made from one continuous tubular bar.

3 Claims, 5 Drawing Figures

TOGGLE BAR FOR EXERCISE AND HEALTH PURPOSES

BACKGROUND OF THE INVENTION

1. Field of Invention

This invention relates to the use of an apparatus for exercising the human body, in particular, the back and joints, and the preventive and remedial treatment of associated health problems.

2. Description of the Prior Art

Apparatus designed for free hanging by the hands is well known in the art. Its value as a preventive and remedial therapeutic exercise is equally well known. Most of the apparatus designed for such purposes consist of stationary bars or gripping devices. A significant advance in the art was made when toggle bars were developed whereby a bar is hingedly suspended at its midpoint and gripped at its outer ends so that by certain movement of the body, a person could cause the bar to oscillate, providing beneficial results. A primary example of such a device is disclosed in U.S. Pat. No. 3,837,642. However, problems existed in finding handles which could be securingly gripped by users with minimal complications and simple, economical and strong designs for the bar as a whole. It is therefore a primary object of this invention to provide an improved toggle bar for brachiation in place by the upper limbs for preventive and remedial exercise and health purposes.

It is a further object of this invention to provide a toggle bar which has improved gripping handles which are formed integrally with the bar.

It is a further object of this invention to provide a toggle bar with handles which allow gripping without obstruction from other parts of the bar.

Another object of this invention is to provide a toggle bar which requires a minimum number of parts.

Another object of this invention is to provide a toggle bar which has increased structural strength.

Another object of this invention is to provide a toggle bar which is easy to use.

These and additional objects, features, and advantages of the invention will become apparent to those skilled in the art with reference to the accompanying drawings.

SUMMARY OF THE INVENTION

This invention utilizes an elongated mid-section member having a J-shaped hanging hook mounted in a clamp-like manner to the middle of this elongated middle section. From each end of the middle section extend two elongated pieces diverging from each other to a point where they are both bent so as to join one another. Thus, the handles present a gripping portion which is generally perpendicular to the axis of the toggle bar itself and yet allows free gripping without interference by the bar. This loop-like configuration defines an enclosed inside area which allows unobstructed and therefore easier use of the bar when in oscillation. Additionally, grips made of a highly grippable material, such as foam rubber, are attached at the appropriate place on the handles to increase the ease and comfort of use.

The middle section can be made from any rigid structural material, but in a modification, this middle section is formed from two parallel metal bars which are integrally formed with the handles so that the entire bar/handle configuration is comprised of one continuous enclosed tubular steel bar; the middle bars being closely adjacent to one another and the handle bars being formed as described above. This design increases structural strength while at the same time decreases the number of parts. All this is accomplished with the added advantage of easier, more comfortable and more functional use provided by the loop-like handles.

DETAILED DESCRIPTION OF PREFERRED EMBODIMENT

Figure 1:
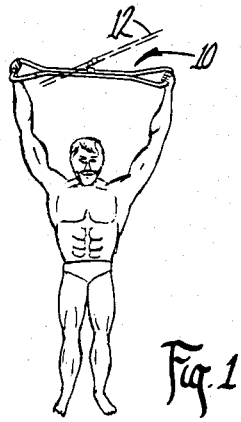
FIG. 1 is a perspective view of the invention in use.

In accordance with the invention, the drawings reveal a toggle bar which will be generally referred to by the reference numeral 10. Reference numeral 12 will refer to the suspension means, most generally a suspension bar, from which the invention 10 is suspended. FIG. 1 shows this relationship and the general mode of use of toggle bar 10.

Figure 2:
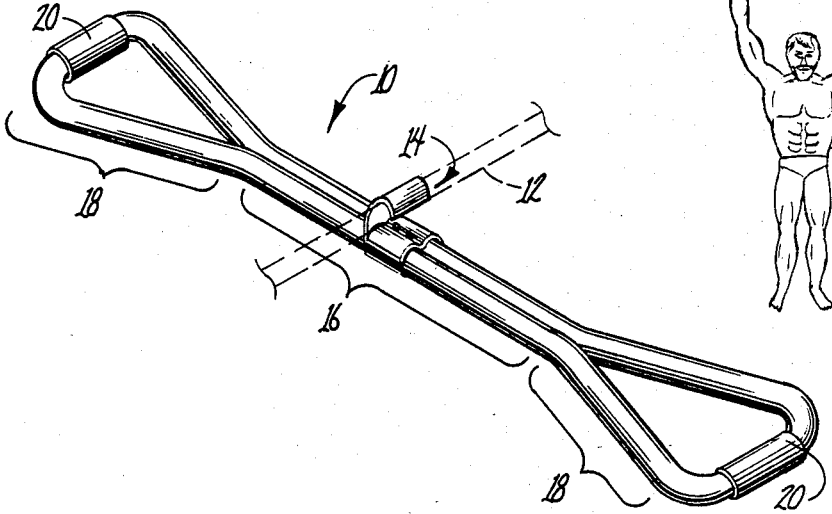
FIG. 2 is a larger perspective view of the invention with the suspension bar (not a part of the invention) shown in ghost lines.
Figure 3:
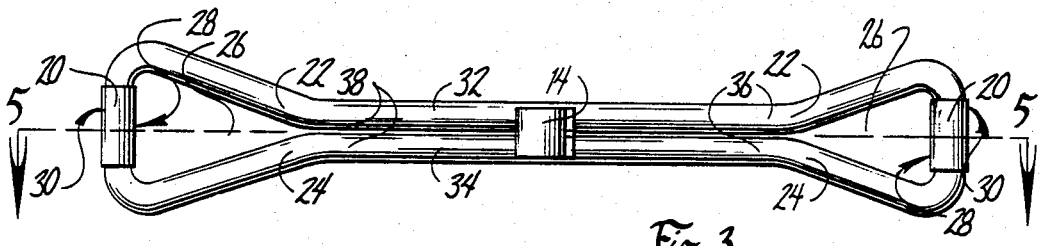
FIG. 3 is a top plan view of the invention.

Toggle bar 10 can be described more specifically with reference to FIG. 2. Hanging means 14 is mounted at approximately the midpoint of middle section 16 of toggle bar 10. Handles 18 extend from both opposite ends of middle section 16 and have gripping elements 20 securingly attached at their furthermost ends. By referring to FIG. 3, the preferred construction of toggle bar 10 can be more specifically pointed out. Middle connecting section 16 can be composed of two parallel closely adjacent elongated tubular bars 32 and 34 having first adjacent ends 36 and second adjacent ends 38. Alternatively, middle connecting section 16 can be composed of a single elongated piece. Each handle member 18 has a first end 22 and a second end 24 which are accordingly adjacent one another after bending of the elongated tubular bar which forms handle member 18 into a loop-like configuration. As a result, first and second ends 36 and 38 of middle connecting bar 32 join first ends 22 of handles 18, respectively, while first and second ends 36 and 38 of middle connecting bar 34 join second ends 24 of handles 18, respectively, to form a self-enclosed continuous tubular bar, as can be seen in particular in FIGS. 2 and 3. As a result, enclosed openings 26 are defined by handle members 18 and therefore, in conjunction with grip elements 20, provide an inside gripping portion 28 and an outside gripping portion 30 for the user's hands.

Figure 4:
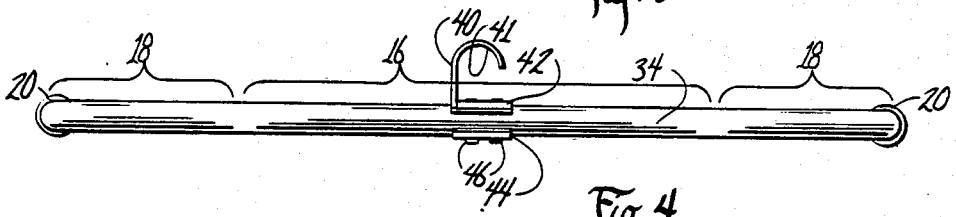
FIG. 4 is a side plan view of the invention.
Figure 5:
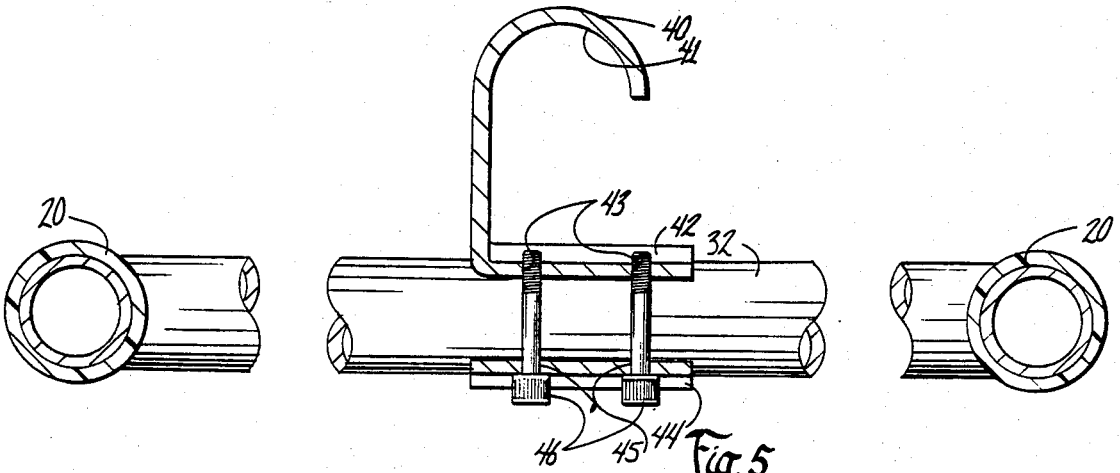
FIG. 5 is a fragmented sectional view as taken along line 5—5 of FIG. 3, depicting various parts of the invention.

Hanging means 14 is comprised of a J-shaped inverted hook member 40 having an inside concave arcuate surface 41 for the slidable pivoting reception of suspension bar 12, in a transversely perpendicular manner to toggle bar 10. J-shaped hook member 40 is connected to top plate 42 which has two threaded apertures and is mounted on the top surfaces of tubular bars 32 and 34 of middle connecting section 16. Bottom plate 44 has two apertures for reception of threaded securing bolts 46 and is mounted on the bottom surfaces of tubular bars 32 and 34. Top plate 42 and bottom plate 44 have double inside concave surfaces for securing reception of tubular bar members 32 and 34 when top and bottom plates 42 and 44 are threadably secured and tightened towards one another by securing bolts 46 passing through apertures 45 in bottom plate 44, passing in between tubular bars 32 and 34 and threadly mating with threaded apertures 43 in top plate 42. The precise construction and cooperation of hanging means 14 is shown in detail in FIG. 4 and FIG. 5.

In operation, J-shaped hook member 40 of hanging means 14 is positioned upon suspension bar 12 as shown in FIG. 1 and FIG. 2. The user then grasps grip elements 20 of handle members 18, one hand on each handle, in such a manner that the user is freely hanging from the toggle bar 10. By the alternating bending of opposite elbows, the user may cause toggle bar 10 to pivot on suspension bar 12 in an oscillating fashion. The construction of handle members 18 with enclosed openings 26 permits wide variation in the method by which the toggle bar 10 may be gripped by the user.

By using the toggle bar, brachiation of the upper limbs is achieved. Users can also strengthen arms and shoulders by hanging from the toggle bar and pulling with one arm at a time. The resulting "see-saw" action allows training without the compressive effects on the spine.

The preferred structure of bar 10 would have a 38 inch long toggle bar mode of chrome plated steel tubular material, with hand grips on either end.

The above described description discloses the preferred embodiment of the invention; however, it is to be understood that changes can be made in the preferred embodiment herein.

What is claimed is:

1. A toggle bar for exercise and health purposes comprising:

a continuous one-piece tubular member having a middle section and handle sections at opposite ends of said middle section;

said middle section comprising elongated, parallel and adjacent lengths of said tubular member;

said handle sections comprising outwardly extending lengths of said tubular member which first diverge from said ends of openings outwardly of said middle section having gripping portions at the extreme opposite ends of said tubular member; and hanging means generally centered along said middle section having an upwardly extending inverted J-shaped hook connected to a securing means comprising top and bottom plates positioned on opposite sides of said middle section and retained by bolt means passing between said elongated, parallel and adjacent lengths of said middle section, said inverted J-shaped hanging hook having an inside concave arcuate surface for slidable pivoting reception of a suspension means, said top plate attached to said hook and having a bottom side with double concave surfaces for reception of and mounting on top of said middle section members and, said bottom plate having a top side with double concave surfaces for reception of and mounting on the bottom of said middle section members.

2. The apparatus of claim 1 wherein said bolt means comprises a bolt extending through said bottom plate having an aperture therefore, said bolt extending upwardly between said middle connecting members and threadably attaching to said top plate member having a threaded aperture therefore.

3. The apparatus of claim 2 wherein said bolt extends between said center section members so that said bolt means is generally hidden and no extrusions of said bolt means extend from the sides of said middle section member.

* * * * *